US006837322B2

(12) United States Patent
Jurado et al.

(10) Patent No.: US 6,837,322 B2
(45) Date of Patent: Jan. 4, 2005

(54) VENTILATION SYSTEM FOR ELECTRIC-DRIVE VEHICLE

(75) Inventors: Augusto Xavier Jurado, Erie, PA (US); Mark Beltowski, Erie, PA (US)

(73) Assignee: General Electric Company, Schenectady, NY (US)

( * ) Notice: Subject to any disclaimer, the term of this patent is extended or adjusted under 35 U.S.C. 154(b) by 85 days.

(21) Appl. No.: 10/126,701

(22) Filed: Apr. 19, 2002

(65) Prior Publication Data

US 2002/0110452 A1 Aug. 15, 2002

Related U.S. Application Data

(63) Continuation-in-part of application No. 09/676,009, filed on Sep. 29, 2000, now Pat. No. 6,382,911.

(51) Int. Cl.[7] ..... F01D 1/02

(52) U.S. Cl. ..... 180/65.4; 180/68.2; 415/206; 416/169 A

(58) Field of Search ..... 415/226, 206, 415/211.2, 144, 224.5, 203, 221, 223; 416/169 A; 180/65.2, 65.3, 65.4, 301, 302, 68.1, 68.2

(56) References Cited

U.S. PATENT DOCUMENTS 4,116,171 A * 9/1978 Schulmeister et al. ... 123/41.57
4,202,296 A * 5/1980 Nonnenmann et al. .. 123/41.48
4,241,666 A 12/1980 Marcusson et al.
4,295,067 A 10/1981 Binder et al.
4,325,451 A 4/1982 Umeda
4,441,462 A 4/1984 Budinski
4,442,682 A 4/1984 Sakata et al.
4,448,573 A 5/1984 Franz
4,604,538 A 8/1986 Merrill et al.
4,719,361 A 1/1988 Brubaker
4,875,521 A 10/1989 Clemente
4,884,946 A * 12/1989 Belanger et al. ..... 415/206
5,253,613 A 10/1993 Bailey et al.
5,446,362 A 8/1995 Vanek et al.
5,609,125 A 3/1997 Ninomiya
5,782,605 A 7/1998 Kohler
5,839,397 A * 11/1998 Funabashi et al. ..... 123/41.01
6,034,451 A * 3/2000 El Mayas ..... 310/63
6,087,746 A 7/2000 Couvert et al.
6,216,778 B1 4/2001 Corwin et al.
6,233,149 B1 5/2001 Bailey et al.
6,363,892 B1 * 4/2002 Zobel et al. ..... 123/41.12

* cited by examiner

*Primary Examiner*—Christopher P. Ellis
*Assistant Examiner*—Brian Swenson
(74) *Attorney, Agent, or Firm*—Carl Rowold; David G. Maire; Beusse Brownlee Wolter Mora & Maire, P.A.

(57) ABSTRACT

A centrifugal blower (70) for an electric-drive vehicle (71) having three independent air outlets (82, 86, 90) receiving air from a single impeller (78). A first radial airflow (84) provides cooling air to an alternator (106) of the vehicle, a second radial airflow (88) provides cooling air to a control group (102) of the vehicle, and an axial airflow (92) provides cooling air to an electric drive motor (108) of the vehicle. The first and second radial airflows are provided through respective first and second outlets (82, 86) formed at radially separated locations in a perimeter of the blower housing (72). The axial airflow is provided through a generally ring-shaped third outlet (90) formed in a sidewall (94) of the housing. An air dam (110) provides a pressure barrier between the radial and axial airflows proximate a location where the first radial airflow is redirected to flow in a generally axial direction.

15 Claims, 4 Drawing Sheets

VENTILATION SYSTEM FOR ELECTRIC-DRIVE VEHICLE

RELATED APPLICATIONS

This application is a continuation in-part of the Sep. 29, 2000, filing date of U.S. patent application Ser. No. 09/676,009, now U.S. Pat. No. 6,382,911 B1 dated May 7, 2002.

FIELD OF THE INVENTION

This invention relates generally to the ventilation system of an electric-drive vehicle, and more particularly, to a multiple outlet centrifugal blower configuration in an electric-drive mining vehicle.

BACKGROUND OF THE INVENTION

Centrifugal blowers are designed to move quantities of air by raising the pressure of the air and discharging it at a desired volumetric flow rate through a pipe or duct. An apparatus requiring cooling, ventilation, or pressurization is often positioned at the discharge port of the pipe or duct. In order for the air to move at a continuous volumetric flow rate through the discharge port to cool, ventilate, or pressurize the apparatus, the air must be supplied with sufficient energy to overcome the downstream backpressure at the outlet. This backpressure is the sum of the pressure drop in the downstream system caused by the resistance of the air moving through the duct and the total air pressure at the discharge port. Oftentimes the downstream system has at least two separate branches through which air must be delivered to a corresponding number of components that require cooling, ventilation, or pressurization. These systems typically include blowers having two or more separate impellers wherein each impeller supplies air at a volumetric flow rate specific to the apparatus connected to its respective discharge port.

Such systems are incorporated into electric-drive off-road mining trucks and various other earth-moving devices, railroad locomotives, and marine vessels. One such mining truck is the KMS 930E provided by Komatsu Mining Systems (www.komatsumining.com). The drive system for such trucks includes a diesel-driven alternator that provides electrical power through a control group to AC drive motors connected to the wheels of the truck. A significant amount of heat is generated during the operation of the AC drive motors. This heat is removed from the drive motors by a supply of cooling air.

It is known to provide cooling air for such mining vehicles from a centrifugal blower connected directly to the drive shaft of the alternator. U.S. Pat. No. 4,448,573 describes a multiple outlet centrifugal blower for such applications. The blower casing includes two outlets that are displaced from one another so as to provide two independent flows of cooling air. One of the airflows is directed to cool the alternator and the other is directed to cool the drive motors. The arcuate extent of the respective outlet openings around the periphery of the impeller may be selected to control the pressure and volume flow rate of the respective airflows. In this type of blower, the total velocity head generated by the impeller blades at the respective arcuate position is used to drive the airflow into the respective outlet.

In addition to removing heat from the alternator and the drive motors, heat must also be removed from the electrical control group components of an electric-drive vehicle. In modern large mining vehicles, the airflow from the alternator shaft blower is dedicated to cooling the alternator.

Cooling air for the drive motors and the control group is provided from two respective impellers situated on a single double-ended auxiliary blower unit. Air moved by the first impeller is ducted to the rear of the vehicle where it is used to cool the AC drive motors located inside the rear wheels of the truck. Air moved by the second impeller is ducted to the deck of the vehicle and is used to cool electrical components associated with the control group of the vehicle. The auxiliary blower unit is driven by an auxiliary AC drive motor, which is powered by an auxiliary inverter connected to the alternator. Such an independent dual-impeller ventilation system offers the benefit of providing independent cooling air flows to the alternator, control group and drive motors. However, such a configuration is mechanically complex and costly to build and to maintain.

What is needed is a ventilation system for an electric drive vehicle that eliminates the auxiliary blower unit yet still provides an independent cooling air flow for each of the alternator, control group and drive motors.

SUMMARY OF THE INVENTION

An apparatus is described herein for providing a flow of pressurized air to each of an alternator, a control group component and an electric drive motor of an electric-drive vehicle. The apparatus includes a housing having an inlet for receiving air; an impeller rotatable about an axis within the housing to accelerate the air in both a radial direction and an axial direction; a first outlet opening formed in a perimeter of the housing to receive a first radial airflow from the impeller for directing the first radial airflow to a first of the alternator, the control group component and the electric drive motor; a second outlet opening formed in the perimeter of the housing radially remote from the first outlet to receive a second radial airflow from the impeller for directing the second radial airflow to a second of the alternator, the control group component and the electric drive motor; and a third outlet opening formed in a side of the housing to receive an axial airflow from the impeller for directing the axial airflow to a third of the alternator, the control group component and the electric drive motor. The third outlet opening may be a generally ring-shaped opening formed in the side of the housing proximate a perimeter of the impeller; and the apparatus may also include an air dam blocking a portion of the ring-shaped opening at a radial location proximate the first outlet opening.

A centrifugal blower is described herein as including: a housing having an inlet for receiving air; an impeller rotatable about an axis within the housing to accelerate the air in both a radial direction and an axial direction; a first outlet opening formed in a perimeter of the housing for receiving a radial airflow from the impeller; a second outlet opening formed in a side of the housing for receiving an axial airflow from the impeller; and a pressure barrier disposed between the first outlet opening and the second outlet opening to isolate the radial airflow from the axial airflow.

An electric-drive vehicle is describe herein as including an internal combustion engine, an alternator driven by the engine, a drive motor powered by the alternator for propelling the vehicle, and a heat-generating control group component, the electric-drive vehicle further including; a blower driven by the engine for producing pressurized air for cooling the alternator, the drive motor and the control group component, the blower further including: a housing; an impeller rotatable about an axis within the housing to accelerate air in both a radial direction and an axial direction; an opening formed in a perimeter portion of the housing for receiving a radial airflow from the impeller; and an opening formed in a side portion of the housing for receiving an axial airflow from the impeller.

DETAILED DESCRIPTION OF THE INVENTION

An enhanced ventilation system utilizes a blower having a single centrifugal impeller coupled directly to the power plant of a vehicle to provide independent flows of air to cool, ventilate, or pressurize at least two and preferably three of the vehicle components. In one embodiment, the ventilation system is installed in an electric-drive mining vehicle utilizing a diesel-powered drive engine. A single blower attached to the alternator drive shaft provides pressurized air to cool the alternator, the drive motors and/or the control group components of the vehicle. The blower design takes advantage of the separate axial and radial velocity components of the air propelled by the impeller to provide the independence of the airflows.

The term "alternator" is used herein to describes machines that produce alternating current as well as machines that produce direct current. Such DC-producing machines are sometimes referred to as generators. For simplicity, such DC-producing machines are included herein under the term alternator.

Figure 5:
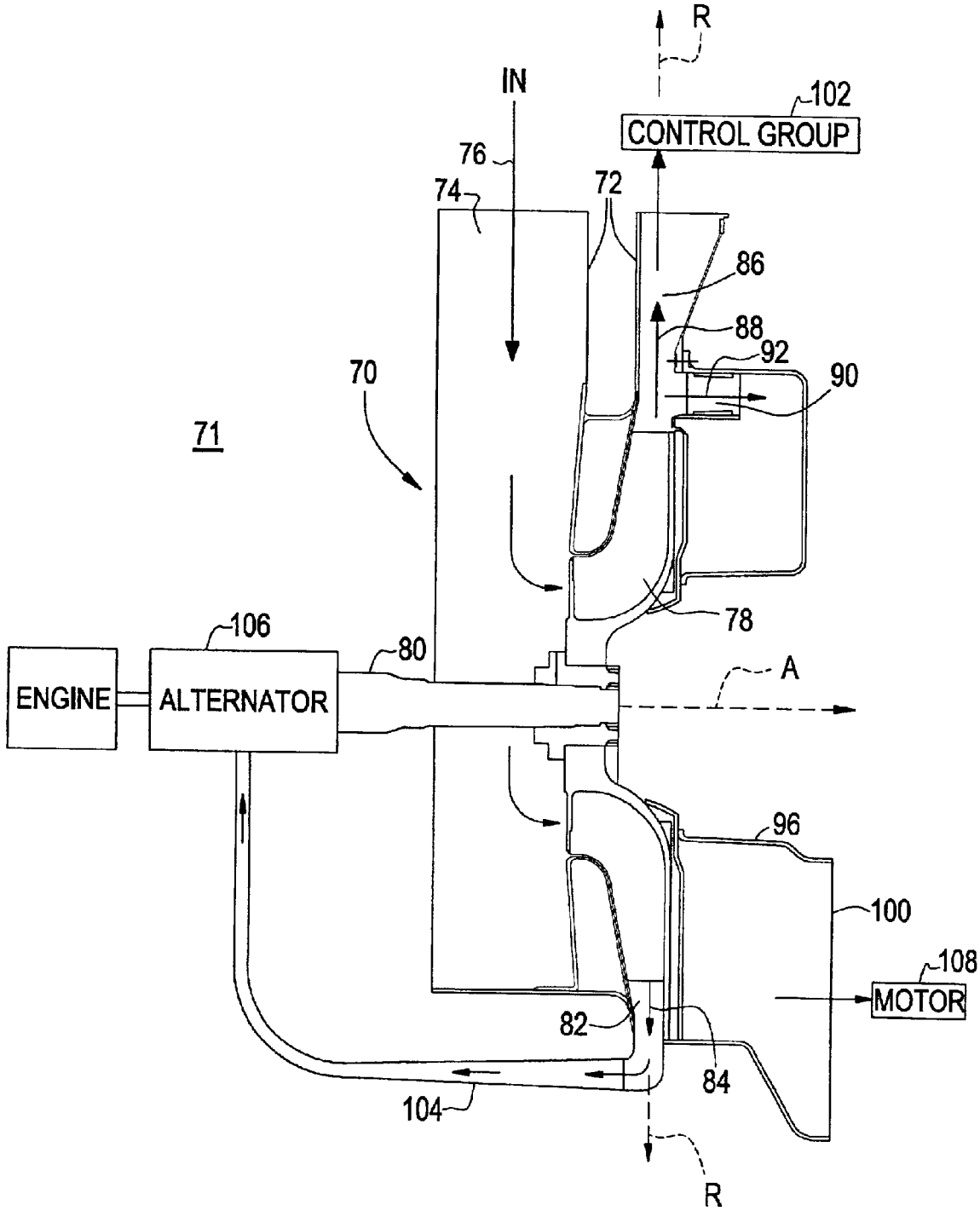
FIG. 5 is a schematic illustration of an electric-drive vehicle showing a side elevation sectional view of a second embodiment of a centrifugal blower.
Figure 6:
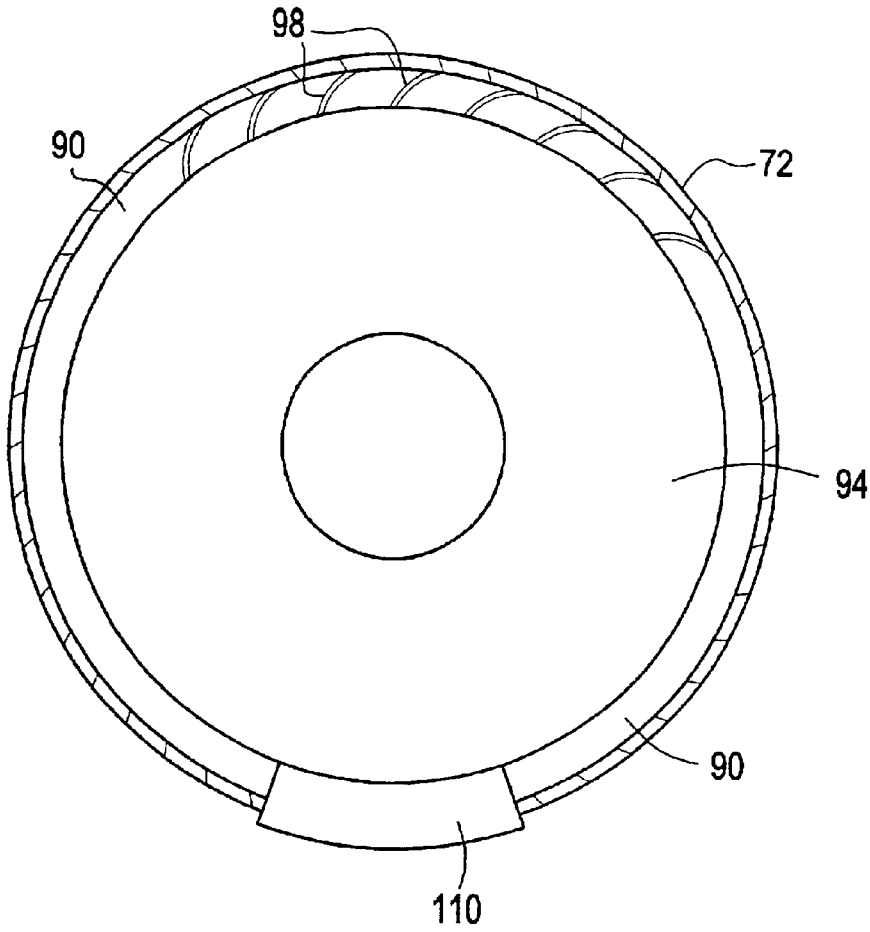
FIG. 6 is an end sectional view of the centrifugal blower of FIG. 5.
Figure 7:
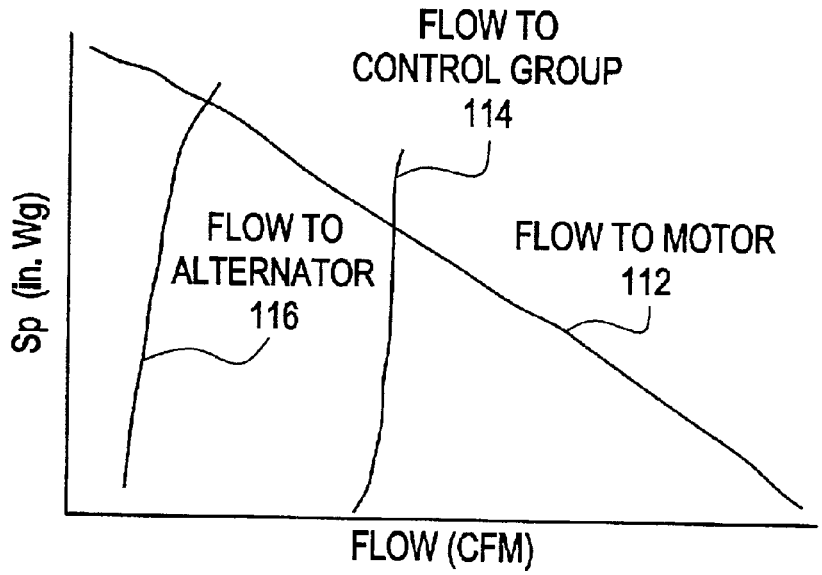
FIG. 7 is a graph illustrating the effect of a restriction in one of the outlet of the centrifugal blower of FIG. 5.

FIGS. 1–4 illustrate a centrifugal blower having two independent outlets. Such a blower may be used to provide cooling air to the alternator and the drive motors of an electric-drive vehicle. FIGS. 5–7 illustrate a centrifugal blower having three independent outlets. Such a blower may be used to provide cooling air to the alternator, the drive motors and the control group of an electric-drive vehicle.

Figure 1:
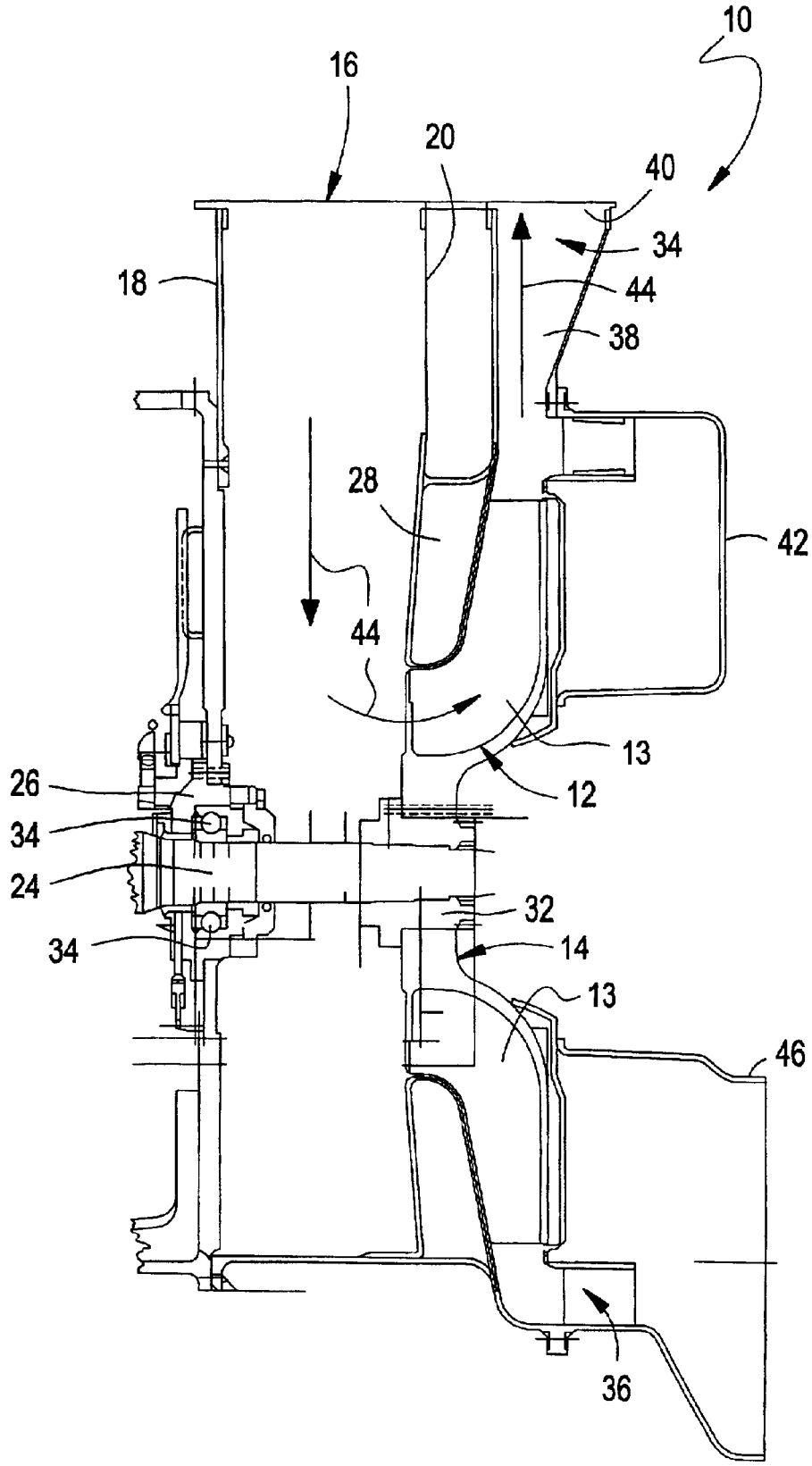
FIG. 1 is a side elevation sectional view of one embodiment of a centrifugal blower.
Figure 2:
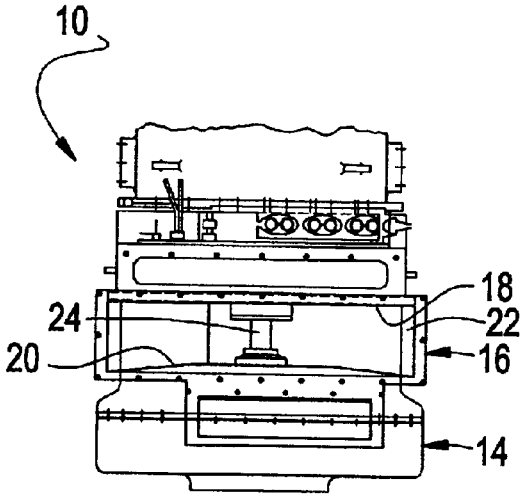
FIG. 2 is a plan view of the centrifugal blower of FIG. 1.
Figure 3:
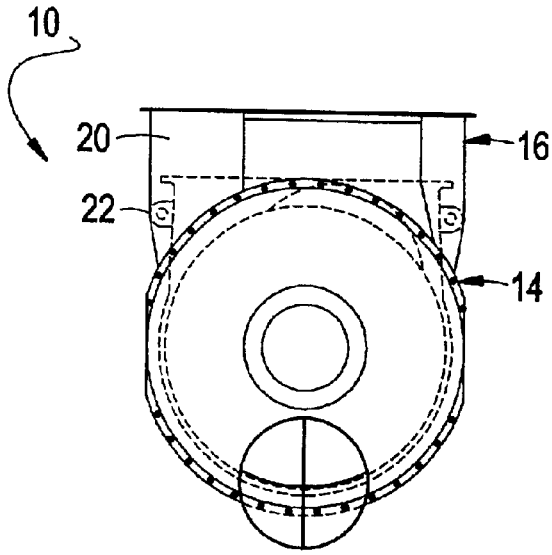
FIG. 3 is a front elevation view of the centrifugal blower of FIG. 1.

Referring to FIGS. 1, 2, and 3, a single stage multiple outlet blower is shown generally at 10, and is hereinafter referred to as "blower 10". Blower 10 comprises an impeller, shown generally at 12 and having a plurality of blades 13 attached thereto, and a housing, shown generally at 14. Although blower 10 may incorporate a plurality of outlet ducts, in the illustrated embodiment blower 10 has two outlet ducts (described below as first outlet duct and second outlet duct) that supply airflows to two separate apparatus for cooling, ventilation, or pressurization. An obstruction in the airflow to one of the two separate apparatus has little or no effect on the airflow to the other of the two separate apparatus and does not impede the normal operation of the apparatus to which the unobstructed airflow is directed.

An inlet chamber, shown generally at 16, is positioned and connected adjacent to housing 14. Inlet chamber 16 serves as the means through which the air is supplied to impeller 12 and comprises a front wall 18 and a back wall 20 positioned in a substantially parallel planar relationship and connected by at least one sidewall 22. The top portion of inlet chamber 16 is open to allow air to enter, while the bottom portion is closed. In one embodiment, the bottom portion is curved to define a continuous wall that forms each sidewall 22, thereby saving space and material in the construction of inlet chamber 16. Back wall 20 is configured to extend toward front wall 18 proximate the center portion of back wall 20. A hole in the center portion of back wall 20 is dimensioned to receive a rotating shaft 24, and apertures are located proximate the hole in the center portion of back wall 20 to accommodate outlet ducts. Front wall 18 has an opening formed in the center portion thereof to accommodate a frame head 26. Inlet chamber 16 may be either fabricated from sheet metal (e.g., steel or aluminum) or molded from a suitable material (e.g., fiberglass).

Housing 14 comprises a structure similar to inlet chamber 16 and is connected to an outer surface of back wall 20 of inlet chamber 16. Housing 14 is configured and dimensioned to closely accommodate the width of each impeller blade 13 and to allow impeller 12 to freely rotate such that the clearance between each blade 13 and the inner walls of housing 14 is minimal. A hole extending through the center portion of housing 14 corresponds with the hole in inlet chamber 16 to receive rotating shaft 24 there through.

Impeller 12 comprises a hub 32 and blades 13 extending from a center portion of hub 32. Blades 13 are tapered and flat and may be either of the paddle-type or of the curvilinear-type in which each blade 13 is curved along a longitudinal plane of its body. Hub 32 is suitably mounted on rotating shaft 24 that extends through housing 14 and inlet chamber 16 where it is rotatably supported by bearings 34 in frame head 26. Rotating shaft 24 is an extension of a rotor shaft, which may be an electric current alternator driven by a diesel engine (not shown) at a speed in the range of 1,800 to about 2,100 revolutions per minute. As shown in FIGS. 1 and 2, rotating shaft 24 extends through the center of housing 14 and inlet chamber 16 and traverses inlet chamber 16. Hub 32 is mounted on the distal end of rotating shaft 24 and protrudes through frame head 26 positioned in front wall 18 of inlet chamber 16.

The side of housing 14 opposite the side to which inlet chamber 16 is connected comprises a first outlet duct and a second outlet duct, shown generally at 36 and 36, respectively. First outlet duct 34 is joined to housing 14 proximate an edge thereof and serves as a means through which air expelled by blower 10 is ducted to system components, e.g., control group elements that pneumatically regulate the supply of pressurized air to operate valves, temperature controllers, fluid-level controllers, safely devices, and other components (not shown). In a preferred embodiment, first outlet duct 34 is positioned at the topmost portion of housing 14 when blower 10 is oriented such that impeller 12 is substantially vertical relative to a level plane of a ground surface (not shown). A throat portion 38 of first outlet duct 34 is dimensioned to have a width that is substantially equal to the width of an impeller blade 13. Throat portion 38 becomes increasingly wider near an outer edge 40 of first outlet duct 34 to enable first outlet duct 34 to be connected to ductwork (not shown) that provides a pathway for air ejected there from to be channeled to the system components that require pressurized air. As can be best seen in FIG. 2, the cross sectional area of first outlet duct 34 is dimensioned to be less than the cross sectional area of inlet chamber 16 to enable the air ejected from first outlet duct 34 to be of a sufficient pressure to adequately power the control group components. A first access cover 42 is removably fastened to housing 14 in order to allow access to throat portion 38 and to impeller 12 for maintenance purposes without disassembling housing 14.

In FIG. 1, arrowed lines 44 illustrate the flow of air through blower 10 in a generally radial direction from the top portion of inlet chamber 16 and in outward radial directions through spaces (not shown) between each impeller blade 13 to the periphery of each impeller blade 13. In this process, the air is accelerated to a high velocity having both radial and axial components, and air pressure increases substantially as a result of the high centrifugal force. As the air passes through first outlet duct 34, the linear radial velocity of the air is gradually reduced, whereby some of the high velocity pressure head of the air is converted into a desired static pressure head. The pressure and volumetric flow rate of the air expelled from the first outlet duct 34 is dependent upon the physical configuration of the ductwork through which the air is channeled to the control group components, as well as the fluid backpressure in that ductwork.

Second outlet duct 36 is joined to housing 14 proximate an edge thereof and is positioned substantially diametrically opposite first outlet duct 34 and serves as a means through which air expelled by blower 10 is ducted away. The axial velocity component of the air drives the air into second outlet duct 36. In one embodiment, the air is ducted to the rear of a truck to ventilate and cool the AC drive motors (not shown) that drive the truck. Second outlet duct 36 extends laterally away from housing 14 to connect to ductwork (not shown), which may or may not be flexible hosing. A second access cover 46 is removably fastened to housing 14 over second outlet duct 36 in order to allow access to impeller 12 without disassembling housing 14.

Figure 4:
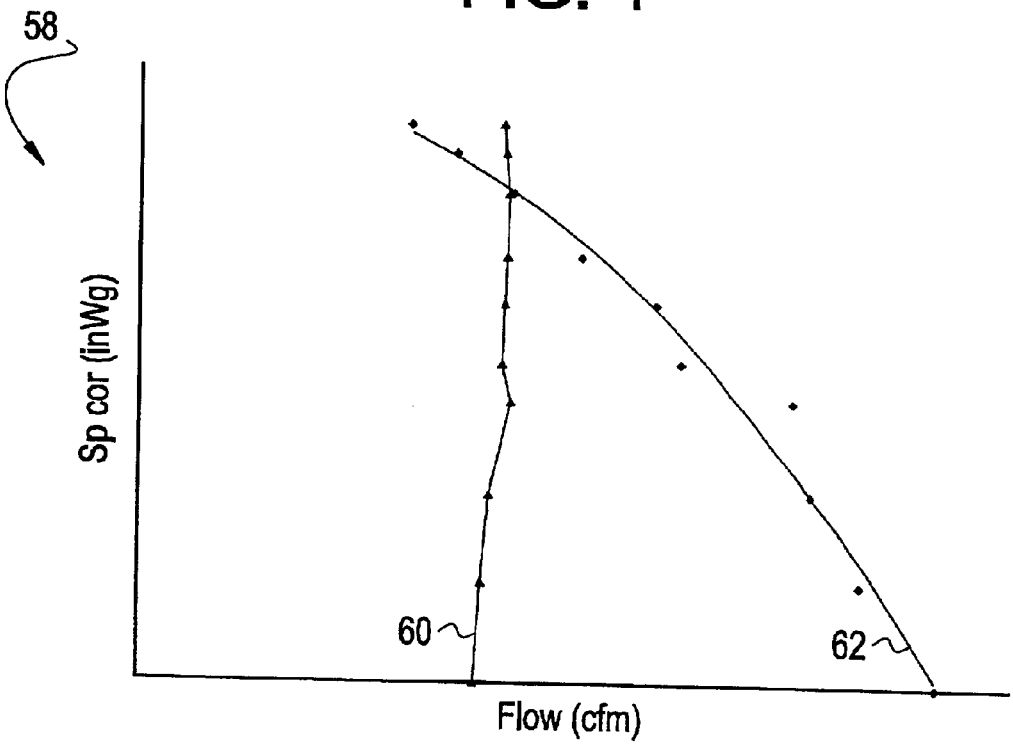
FIG. 4 is a graph illustrating the effect of a restriction in one of the outlets of the centrifugal blower of FIG. 1.

Referring to FIG. 4, the dual functionality of the radially and axially placed outlet ducts is shown generally by graph 58. Graph 58 illustrates the flow curve characteristics of static pressure in the ductwork between blower 10 and both the control group components and the AC drive motors. In a plot of corrected static pressure versus volumetric flow rate, a line 60 represents an airflow from a discharge port (not shown) to the control group. A line 62 represents an airflow from a discharge port (not shown) to the AC drive motors. The verticality of line 60 indicates substantially constant airflow at the control group discharge port while the airflow to the AC drive motors is obstructed, as shown by the downward curving of line 62. From graph 58 it can be concluded that neither the amount of backpressure of the air discharged from each outlet duct nor variations in the airflow resistance of the downstream discharge ports connected to each outlet duct will significantly affect the flow of air discharging from the other outlet duct. The pressure and volumetric flow rate of air discharging from one outlet duct is substantially independent of the pressure and volumetric flow rate of air from the other outlet duct. The pressure and volumetric flow rate are instead functions of the fluid backpressure at the discharge port of each outlet duct 34, 36, which are in turn functions of the cross sectional area of each outlet duct 34, 36 and the physical configuration of the ductwork to which it connects.

FIG. 5 illustrates a centrifugal blower 70 of an electric-drive vehicle 71 having three independent air outlets. The blower 70 includes a housing 72 having an inlet 74 for receiving inlet air 76 and an impeller 78 disposed within the housing 72 and rotated on a drive shaft 80 about an axis A. The impeller 78 receives the inlet air 76 proximate the axis A and accelerates the air 76 in both a radial direction R and an axial direction A. Blower 70 includes a first outlet 82 formed in a perimeter portion of the housing 72 for receiving a first radial airflow 84 from the impeller 78. Blower 70 also includes a second outlet 86 formed in a perimeter portion of the housing 72 for receiving a second radial airflow 88 from the impeller 78. Blower 70 further includes a third outlet 90 for receiving an axial airflow 92 from the impeller 78.

The shape of third outlet 90 may be better appreciated by viewing FIG. 6, which is a partial sectional end view of blower 70. Third outlet 90 is formed as a generally ring shaped opening in a sidewall 94 of housing 72. Outlet 90 permits the passage of the axial airflow 92 into a generally donut-shaped plenum 96. One or more flow-directing vanes 98 may be positioned in or near opening 90 to direct the axial airflow 92 toward a plenum outlet 100.

In the embodiment of FIGS. 5–6, first outlet 82 directs the first radial airflow 84 in a generally upward direction to a control group 102 of the electric-drive vehicle 71. Second outlet 82 is connected to a duct 104 that redirects the first radial airflow 84 to flow forward in a generally axial direction to the alternator 106 of the electric-drive vehicle 71. Third outlet 90 directs the axial airflow 92 through the plenum 96 in a generally rearward direction to the electric drive motors 108 of the electric-drive vehicle 71. One may appreciate that in other embodiments, the various airflows may be directed to various components. For example, the first radial airflow 82 may be directed to a first of the control group 102, the alternator 106 or the motor 108; the second radial airflow 88 may be directed to a second of the control group 102, the alternator 106 or the motor 108; and the axial airflow 92 may be directed to a third of the control group 102, the alternator 106 or the motor 108.

The first outlet 82 is formed in the perimeter of the housing radially remote from the second outlet 86 in order to provide relatively independent fluid flow characteristics to the first radial airflow 84 and the second radial airflow 88. The fluid flow independence of the axial airflow 92 is provided by the distinct radial and axial velocity components of the air as it is accelerated by the impeller 78. In the embodiment of FIGS. 5 and 6, the physical geometry of the electric-drive vehicle 71 makes it necessary to redirect the first radial airflow 84 to a generally axial direction immediately downstream of the outlet 82. Such a change in direction would tend to impart both a forward and a rearward axial velocity component to the airflow. In order to maintain the fluid independence of the first radial airflow 82 and the axial airflow 92, it is necessary to impose a pressure boundary there between. The pressure boundary is formed as an air dam 110 blocking a portion of the ring-shaped opening 90 at a radial location proximate the first outlet opening 82. The air dam 110 has a radial extent sufficient to maintain the relative fluid flow independence of first radial airflow 82 and axial airflow 92, and in one embodiment may block approximately 50–60 of the 360 arc of opening 90.

FIG. 7 illustrates the relative independence of the three airflows generated by centrifugal blower 70. FIG. 7 is a graph of static pressure (vertical axis) verses airflow (horizontal axis). The static pressure is the pressure measured at a point within the plenum 96. Line 112 represents the airflow 92 that is provided to the AC drive motors 108 over a range of pressures. The flexible ducts (not shown) that carry the airflow 92 to the rear of the electric-drive vehicle 71 are at a relatively high risk of physical damage, it is possible that such ducts may become damaged or dislodged from motor 108. Such an event would cause the pressure in plenum 96 to drop and the airflow 92 to increase along line 112. It is important that such a failure not result in the loss of cooling airflow to the control group 102 or the alternator 106. Curve 114 illustrates the airflow 88 provided to the control group 102 over a range of pressures in plenum 96. The verticality of line 114 indicates substantially constant airflow to the control group 102 when the airflow to the drive motors 108 is either obstructed or excessive. Similarly, curve 116 illustrates the airflow 84 to the alternator 106 over a range of pressures in plenum 96. The total flow to the alternator 106 is also independent of the flow rate 112 to the motors 108 and the flow rate 114 to the control group 102. From FIG. 7 it can be concluded that neither the amount of backpressure of the air discharged from each outlet nor variations in the airflow resistance of the downstream components connected to each outlet will significantly affect the flow of air discharging from others of the outlets. The pressure and volumetric flow rate of air discharging from each of the outlets 82, 86, 90 is substantially independent of the pressure and volumetric flow rate of air from the other of the outlets 82, 86, 90. The pressure and volumetric flow rates are instead functions of the fluid backpressure at the discharge port of each respective outlet, which are, in turn, functions of the cross sectional area of the respective outlet and the physical configuration of the components to which it connects.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An electric-drive vehicle comprising an internal combustion engine, an alternator driven by the engine, a drive motor powered by the alternator for propelling the vehicle, and a heat-generating control group component, the electric-drive vehicle further comprising;

a blower driven by the engine for producing pressurized air for cooling the alternator, the drive motor and the control group component, the blower further comprising:

a housing;

an impeller rotatable about an axis within the housing to accelerate air in both a radial direction and an axial direction;

an opening formed in a perimeter portion of the housing for receiving a radial airflow from the impeller; and an opening formed in a side portion of the housing for receiving an axial airflow from the impeller.

2. The electric-drive vehicle of claim 1, further comprising an air dam disposed between the opening formed in a perimeter portion of the housing and the opening formed in a side portion of the housing.

3. The electric-drive vehicle of claim 2, further comprising a duct in fluid communication with the opening formed in the perimeter of the housing, the duct shaped to redirect the radial airflow to flow in a generally axial direction.

4. The electric-drive vehicle of claim 1, wherein the opening formed in a perimeter portion of the housing is a first opening formed in the perimeter portion of the housing to receive a first radial airflow from the impeller, and further comprising:

a second opening formed in the perimeter portion of the housing radially displaced from the first opening to receive a second radial airflow from the impeller.

5. The electric-drive vehicle of claim 4, further comprising:

a duct in fluid communication with the first opening formed in the perimeter portion of the housing and shaped to redirect the first radial airflow to flow in a generally axial direction; and a pressure barrier disposed between the first opening formed in the perimeter portion of the housing and the opening formed in the side portion of the housing.

6. The electric-drive vehicle of claim 5, wherein the first radial airflow is directed to cool the alternator, the second radial airflow is directed to cool the control group component, and the axial airflow is directed to cool the electric drive motor.

7. An electric-drive vehicle comprising;

an engine; and a blower powered by the engine for producing a first flow of cooling air and a second flow of cooling air, the blower further comprising:

a housing;

an impeller rotatable about an axis within the housing to produce an airflow having both a radial component and an axial component;

a first radial outlet opening formed in a perimeter portion of the housing for receiving the radial component to produce the first flow of cooling air; and a second axial outlet opening formed in a side portion of the housing for receiving the axial component to produce the second flow of cooling air.

8. The electric-drive vehicle of claim 7, further comprising an air dam disposed between the first opening and the second opening.

9. The electric-drive vehicle of claim 7, further comprising:

a control group component receiving the first flow of cooling air; and an electric drive motor receiving the second flow of cooling air.

10. The electric-drive vehicle of claim 7, wherein the first opening receives a first portion of the radial airflow to produce the first flow of cooling air, and further comprising:

a third opening formed in the housing remote from the first opening for receiving a second portion of the radial airflow to produce a third flow of cooling air.

11. The electric-drive vehicle of claim 10, further comprising an air dam disposed between the third opening and the second opening.

12. The electric-drive vehicle of claim 10, further comprising:

the first opening being formed in a perimeter portion of the housing;

the second opening being formed in a side portion of the housing; and the third opening being formed in the perimeter portion of the housing remote from the first opening.

13. The electric-drive vehicle of claim 12, further comprising:

a control group component receiving the first flow of cooling air, an electric drive motor receiving the second flow of cooling air; and an alternator receiving the third flow of cooling air.

14. The electric-drive vehicle of claim 10, wherein the electric-drive vehicle comprises an alternator, a control group component and an electric drive motor, further comprising:

a first passageway directing the first flow of cooling air to a first of the group of the alternator, the control group and the electric drive motor;

a second passageway directing the second flow of cooling air to a second of the group of the alternator, the control group and the electric drive motor; and a third passageway directing the third flow of cooling air to a third of the group of the alternator, the control group and the electric drive motor.

15. An electric-drive vehicle comprising an internal combustion engine and at least two heat-generating components, the electric-drive vehicle comprising:

a blower powered from the engine for producing at least two independent flows of cooling air for delivery respectively to the at least two heat-generating components, the blower further comprising:

a housing;

an impeller rotatable in a 360° arc about an axis within the housing;

a perimeter opening formed in a perimeter portion of the housing proximate a first portion of the arc for receiving a radial flow of air from the impeller to produce a first of the two independent flows of cooling air;

a side opening extending formed in a side portion of the housing proximate a second portion of the arc for receiving an axial flow of air from the impeller to produce a second of the two independent flows of cooling air;

wherein the second portion of the arc encompasses and extends beyond the first portion of the arc.

* * * * *